US008768222B2

(12) United States Patent
Okamoto et al.

(10) Patent No.: US 8,768,222 B2
(45) Date of Patent: Jul. 1, 2014

(54) POWDER FEED DEVICE AND IMAGE FORMING APPARATUS

(75) Inventors: Masaya Okamoto, Kanagawa (JP); Kaoru Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 145 days.

(21) Appl. No.: 13/565,517

(22) Filed: Aug. 2, 2012

(65) Prior Publication Data

US 2013/0251412 A1 Sep. 26, 2013

(30) Foreign Application Priority Data

Mar. 26, 2012 (JP) ..... 2012-069516

(51) Int. Cl.
*G03G 15/08* (2006.01)

(52) U.S. Cl.
USPC ..... 399/258; 399/262; 399/263

(58) Field of Classification Search
USPC ..... 399/107, 110, 111, 119, 120, 252–263
See application file for complete search history.

(56) References Cited

U.S. PATENT DOCUMENTS

| | | | | |
|---|---|---|---|---|
| 5,325,163 | A | 6/1994 | Nishio | |
| 7,167,668 | B2 * | 1/2007 | Sekiguchi | 399/258 |
| 7,856,196 | B2 | 12/2010 | Sakamoto et al. | |
| 8,554,117 | B2 * | 10/2013 | Okuda et al. | 399/262 |
| 2009/0103952 | A1 | 4/2009 | Sakamoto et al. | |

FOREIGN PATENT DOCUMENTS

| | | | |
|---|---|---|---|
| JP | 05-127524 | A | 5/1993 |
| JP | 06-130807 | A | 5/1994 |
| JP | 2000-098724 | A | 4/2000 |
| JP | 2008-216925 | A | 9/2008 |
| JP | 2008216925 | A | 9/2008 |
| JP | 2009098422 | A | 5/2009 |
| JP | 2011-227532 | A | 11/2011 |
| JP | 2011227532 | A | 11/2011 |

OTHER PUBLICATIONS

Office Action issued by Japanese Patent Office in corresponding Japanese Patent application No. 2012069516, dated May 7, 2013.

* cited by examiner

*Primary Examiner* — Hoan Tran
(74) *Attorney, Agent, or Firm* — Sughrue Mion, PLLC

(57) ABSTRACT

A powder feed device includes a casing having an opening for receiving a powder from a powder housing portion housing the powder, at least an inner side of the casing having a cylindrical shape; a transport member that is arranged in the casing, extends in a powder transport direction, and rotates and transports the powder to the fed body; and a shutter member that is arranged at a closed position for closing the opening, receives a force from the transport member by its rotation, and moves to an open position for opening the opening. The transport member includes a transport portion that contributes to the powder transport, and a non-transport portion that does not contribute to the powder transport, and handles the movement of the shutter member to the open position. The shutter member moves to the open position when receiving an effect of the non-transport portion.

6 Claims, 6 Drawing Sheets

POWDER FEED DEVICE AND IMAGE FORMING APPARATUS

CROSS-REFERENCE TO RELATED APPLICATIONS

This application is based on and claims priority under 35 USC 119 from Japanese Patent Application No. 2012-069516 filed Mar. 26, 2012.

BACKGROUND

The present invention relates to a powder feed device and an image forming apparatus.

SUMMARY

According to an aspect of the invention, there is provided a powder feed device including a casing having an opening, a powder sent from a powder housing portion being received through the opening, the powder housing portion housing the powder, the casing extending to a fed body, the fed body being fed with the powder, at least an inner side of the casing having a substantially cylindrical shape; a transport member that rotates and transports the powder received in the casing through the opening to the fed body, the transport member being arranged in the casing and extending in a transport direction, the powder being transported in the transport direction; and a shutter member that is arranged at a closed position at which the opening is closed, receives a force from the transport member by the rotation of the transport member, and moves to an open position at which the opening is open. The transport member includes a transport portion that contributes to the transport of the powder, and a non-transport portion that does not contribute to the transport, and handles the movement of the shutter member to the open position. The shutter member moves to the open position when the shutter member receives an effect of the non-transport portion.

BRIEF DESCRIPTION OF THE DRAWINGS

An exemplary embodiment of the present invention will be described in detail based on the following figure, wherein.

DETAILED DESCRIPTION

An exemplary embodiment of the present invention is described below.

Figure 1:
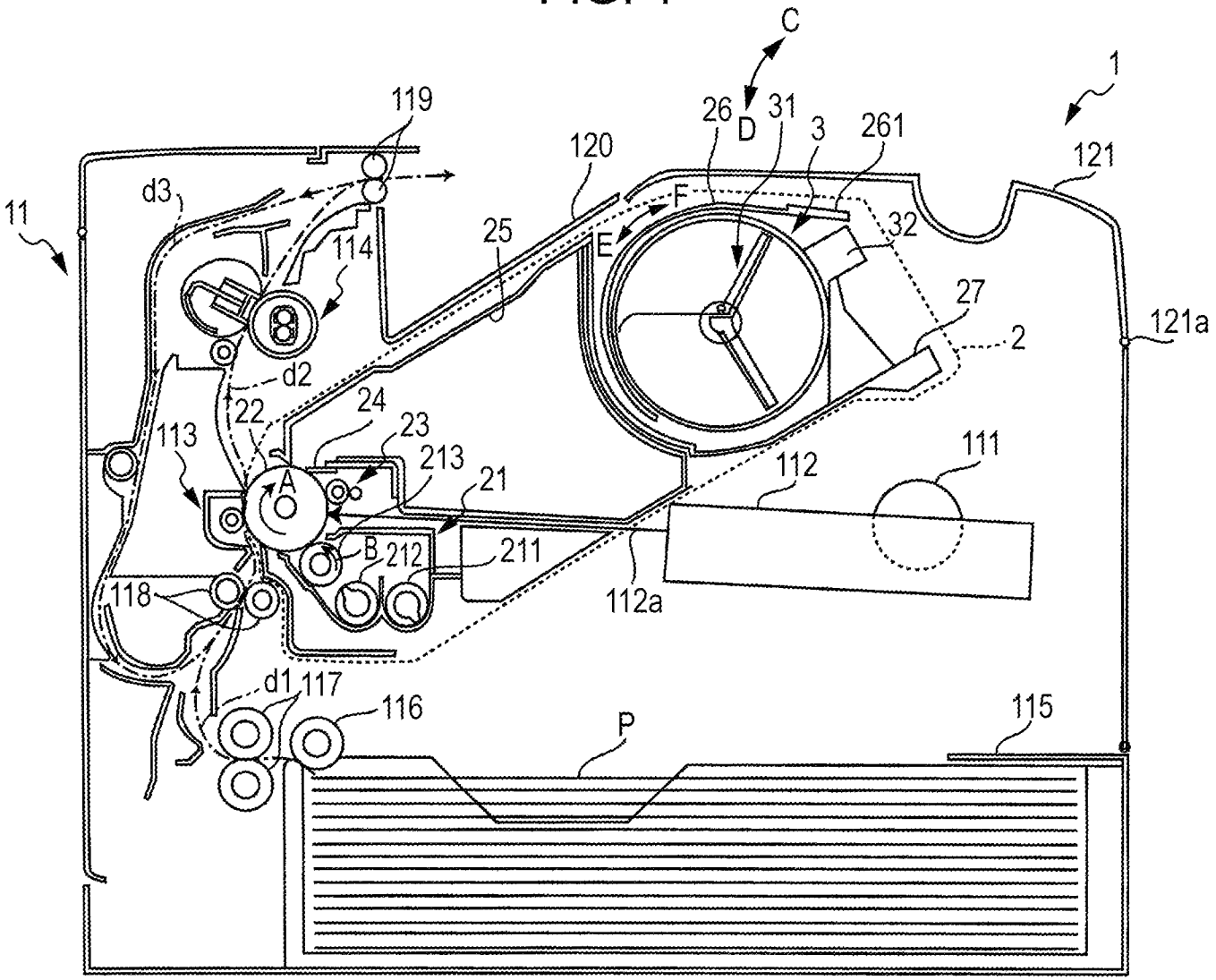
FIG. 1 is a schematic configuration diagram of a printer that is an image forming apparatus according to an exemplary embodiment of the present invention, the printer including a toner feed device that is a powder feed device according to the exemplary embodiment of the present invention.

FIG. 1 is a schematic configuration diagram of a printer 1 that is an image forming apparatus according to an exemplary embodiment of the present invention, the printer 1 including a toner feed device 4 that is a powder feed device according to the exemplary embodiment of the present invention.

The printer 1 shown in FIG. 1 is a printer that prints an image on paper P by an electrophotographic system. In FIG. 1, a side surface at the right side is a front surface of the apparatus. The printer 1 includes a printer body 11. A process cartridge 2 is removably mounted on the printer body 11 from the front surface of the apparatus. Even if the process cartridge 2 is mounted on the printer body 11, a toner cartridge 3 is removably mounted on the process cartridge 2 from the front surface of the apparatus.

The toner cartridge 3 houses a toner for supply. This toner corresponds to an example of a powder according to the exemplary embodiment of the present invention. The toner in the toner cartridge 3 is stirred by rotation of a stirring member 31 and hence the toner is prevented from being aggregated. A drive force is transmitted to the stirring member 31 from a motor 111 provided in the printer body 11 through gears (described later). The toner in the toner cartridge 3 is fed to a developing unit 21 provided in the process cartridge 2.

The process cartridge 2 includes, in addition to the developing unit 21, a photoconductor 22, a charging unit 23, and a cleaner 24. A waste-toner housing chamber 25 is provided between the toner cartridge 3, and the developing unit 21 and the photoconductor 22. The waste-toner housing chamber 25 houses a waste toner that is scraped from the photoconductor 22 by the cleaner 24.

Further, the printer body 11 includes an exposure unit 112 that radiates the photoconductor 22 with exposure light 112*a*, and a transfer unit 113 that is arranged at a position to face the photoconductor 22.

The photoconductor 22 receives various effects (described later) while the photoconductor 22 is rotated in a direction indicated by arrow A.

The charging unit 23 causes the surface of the photoconductor 22 to be electrically charged with a predetermined potential.

The exposure unit 112 radiates the electrically charged surface of the photoconductor 22 with the exposure light 112*a* corresponding to an image signal, and forms an electrostatic latent image on the surface of the photoconductor 22.

The developing unit 21 houses a developer containing a carrier and a toner. The developer moves in a circulating manner in a direction perpendicular to a paper face of FIG. 1 by rotation of two augers 211 and 212. The developer in the developing unit 21 is transported to a development position facing the photoconductor 22 by a development roller 213 that is rotated in a direction indicated by arrow B. The toner in the developer develops the electrostatic latent image on the photoconductor 22, and hence a toner image is formed on the photoconductor 22. The toner image formed on the photoconductor 22 is transferred on paper P transported in a manner described later, and is transferred on the paper P by an effect of the transfer unit 113. The toner image on the paper P receives heat and pressure from a fixing unit 114 provided in the printer body 11, and hence the toner image is fixed to the paper P.

A paper cartridge 115 is mounted in a lower portion of the printer body 11 so that the paper cartridge 115 may be pulled out to the right side in FIG. 1. Plural sheets of paper P before printing are housed in the paper cartridge 115 in a stacked manner. For printing, paper P that is stacked on the top of the plural sheets of paper P housed in the paper cartridge 115 is picked up by a pickup roller 116. Even if plural sheets of paper P in a stacked manner are picked up, a separation roller 117 reliably separates the plural sheets of paper P one by one. The separated paper P is transported through a transport path d1 and reaches a registration roller 118. The registration roller 118 corrects the posture of the transported paper P, adjusts a transport timing for a downstream process, and sends the paper P to the downstream process. The registration roller 118 sends the paper P in synchronization with a transfer timing of the toner image on the photoconductor 22. The toner image on the photoconductor 22 is transferred on the paper P. The paper P with the toner image transferred is further transported through a transport path d2, passes through the fixing unit 114 so that the toner image is fixed to the paper P, and is output onto an output tray 120 by a paper output roller 119. The output tray 120 is provided at an upper portion of the printer body 11.

For printing on both sides of paper P, paper P with an image printed on one side in the above-described manner is sent by the paper output roller 119 to an intermediate position, then the paper output roller 119 is reversely rotated, the paper P is transported through a transport path d3, and the paper P reaches the registration roller 118 again. Then, the above-described printing operation is repeated again, the paper P with images printed on both sides is output onto the paper output tray 120 by the paper output roller 119.

A cover 121 that is a part of covers of the printer body 11 is openable and closable in a direction indicated by arrows C and D around a hinge portion 121*a*, i.e., to the front surface side of the apparatus. When the cover 121 is opened, a grip 261 of a semi-cylindrical fixing member 26 provided at the process cartridge 2 is gripped with a hand, and the fixing member 26 is rotated in a direction indicated by arrow E, an attachment/detachment opening is opened for attachment and detachment of the toner cartridge 3, and the toner cartridge 3 may be removed by pulling a grip 32 of the toner cartridge 3. When the toner cartridge 3 is mounted on the process cartridge 2, an operation reverse to the above-described operation is performed. In particular, the grip 32 of the toner cartridge 3 is gripped with a hand, the toner cartridge 3 is mounted on the process cartridge 2, then the grip 261 of the fixing member 26 of the process cartridge 2 is gripped with the hand, and the fixing member 26 is rotated in a direction indicated by arrow F. When the fixing member 26 is rotated in the direction indicated by arrow F, the toner cartridge 3 is fixed at a predetermined position in the process cartridge 2. Then, the cover 121 is closed in the direction indicated by arrow D.

Also, when the process cartridge 2 itself is replaced, for example, because the photoconductor 22 is deteriorated, the cover 121 is opened, then a grip 27 of the process cartridge 2 is gripped, the process cartridge 2 is pulled and removed regardless of the presence of the toner cartridge 3, and a new process cartridge 2 may be mounted by an operation reverse to the above-described operation.

Figure 2:
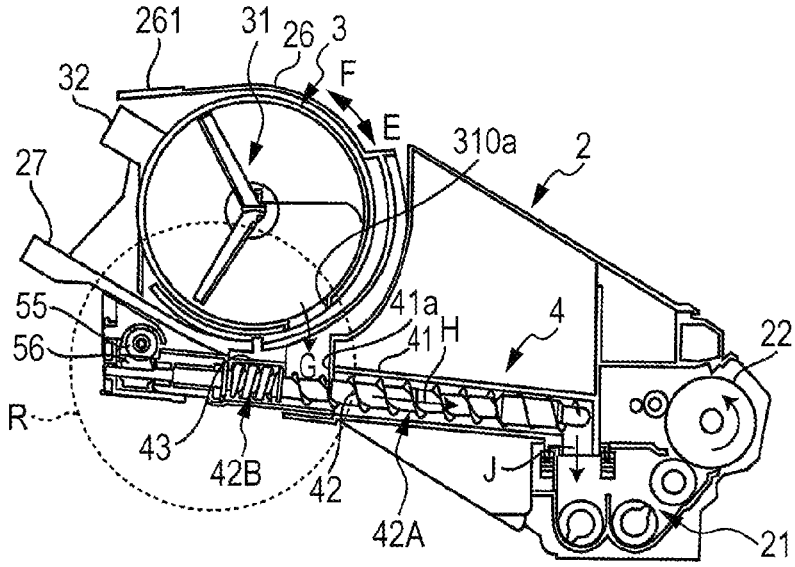
FIG. 2 is a cross-sectional view of a process cartridge when the process cartridge is cut along a plane different from a plane of FIG. 1 and when the process cartridge is viewed from the back side of a paper face of FIG. 1.

FIG. 2 is a cross-sectional view of the process cartridge 2 when the process cartridge 2 is cut along a plane different from a plane of FIG. 1 and when the process cartridge 2 is viewed from the back side of the paper face of FIG. 1.

The toner cartridge 3 has an opening 310*a* at a lower portion when the toner cartridge 3 is mounted. The toner in the toner cartridge 3 is fed to the developing unit 21 through the opening 310*a*. The opening 310*a* is closed with a shutter when the toner cartridge 3 is separated from the process cartridge 2. When the toner cartridge 3 is mounted on the process cartridge 2 and the fixing member 26 of the process cartridge 2 is rotated in the direction indicated by arrow F, the shutter is opened.

The toner housed in the toner cartridge 3 is sent in a direction indicated by arrow G through the opening 310*a*, is received in a casing 41 of the toner feed device 4 through an opening 41*a* provided at the casing 41, is transported in a transport direction indicated by arrow H by rotation of a transport member 42 arranged in the casing 41, falls in a direction indicated by arrow J, and is fed to the developing unit 21.

The toner feed device 4 corresponds to an example of a powder feed device according to the exemplary embodiment of the present invention, and also corresponds to an example of a powder feed unit in the image forming apparatus according to the exemplary embodiment of the present invention. Also, the developing unit 21 corresponds to a fed body in the powder feed device according to the exemplary embodiment of the present invention.

The detail of the toner feed device 4 is described later.

Figure 3:
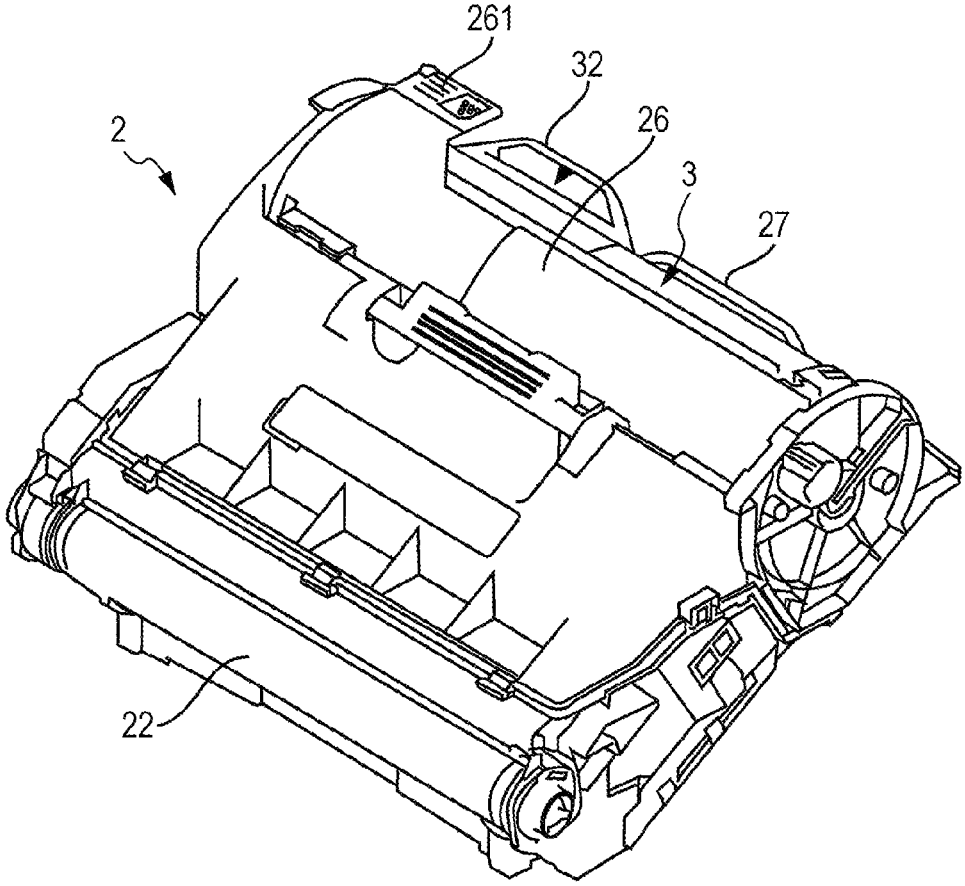
FIG. 3 is an external perspective view when the process cartridge with a toner cartridge mounted is viewed from a photoconductor side.

FIG. 3 is an external perspective view when the process cartridge 2 with the toner cartridge 3 mounted is viewed from the photoconductor 22 side.

In FIG. 3, the cylindrical photoconductor 22 is illustrated at a lower left side, and the toner cartridge 3 and the grip 32 of the toner cartridge 3 are illustrated at an upper right side. A major part of the toner cartridge 3 is covered with the semi-cylindrical fixing member 26 provided at the process cartridge 2. In FIG. 3, the fixing member 26 is rotated in the direction indicated by arrow F in FIGS. 1 and 2, and fixes the toner cartridge 3 to the process cartridge 2. FIG. 3 also illustrates the grip 261 for rotating the fixing member 26, and the grip 27 for pulling out the entire process cartridge 2 from the printer body 11 (See FIG. 1).

Figure 4:
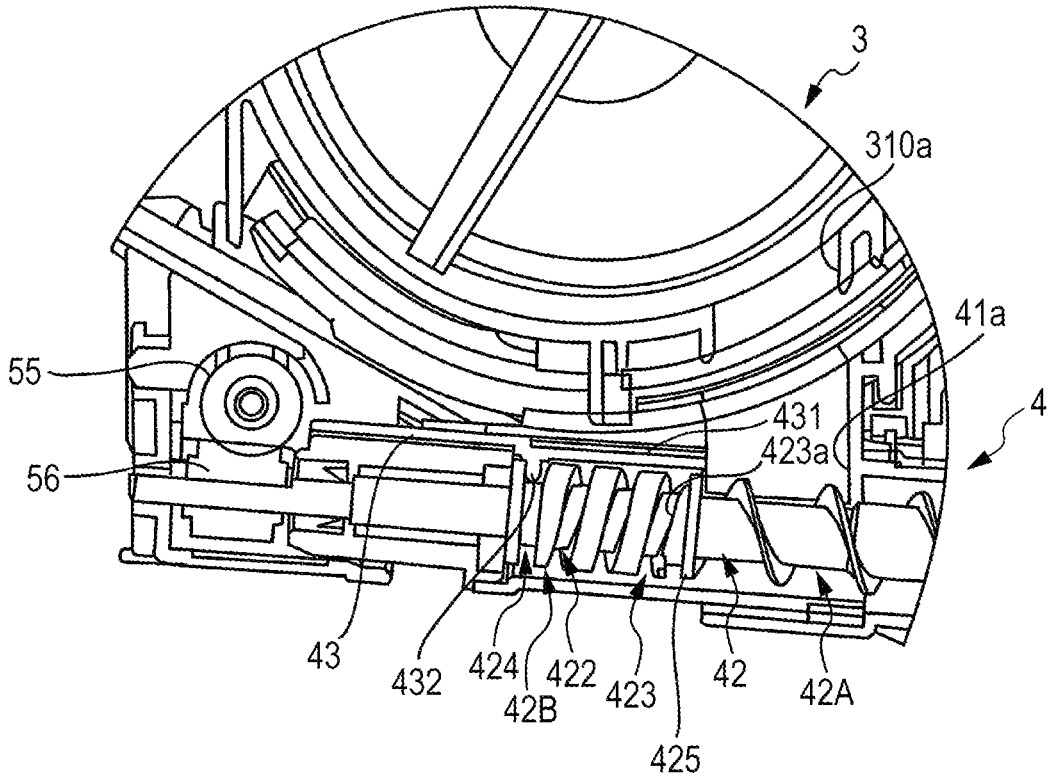
FIG. 4 is an enlarged view of part indicated by circle R in FIG. 2.

FIG. 4 is an enlarged view of part indicated by circle R in FIG. 2. Hereinafter, the toner feed device 4 is described in detail with reference to FIGS. 2, and 4 and later figures.

The toner feed device 4 includes the casing 41 and the transport member 42. The casing 41 has the opening 41*a* through which the casing 41 receives the toner from the toner cartridge 3. The casing 41 is a hollow cylindrical casing extending to the developing unit 21 that is a feed target of the received toner.

It is to be noted that the cylindrical shape may be satisfied as long as at least an inner side of the casing 41 has a substantially cylindrical shape. An outer periphery shape of the casing 41 is not limited to a circular shape. Also, the casing 41 may be unitized with or formed separately from the process cartridge 2.

Also, the transport member 42 is arranged in the casing 41, extends in the transport direction in which the toner is transported, is rotated when the transport member 42 receives a drive force from the motor 111 (see FIG. 1), and transports the toner received in the casing 41 through the opening 41*a* to the developing unit 21.

Further, the toner feed device 4 includes a shutter member 43. The shutter member 43 is arranged at a closed position at which the shutter member 43 closes an opening 42*a* before the transport member 42 is rotated for the first time (initial rotation) or when the process cartridge 2 is new. The shutter member 43 receives the force from the transport member 42 by the initial rotation of the transport member 42 and moves to an open position at which the shutter member 43 opens the opening 42*a*. Hence, the toner is not present in the casing 41 of the toner feed device 4 before the printer 1 is operated. A phenomenon, in which the toner is aggregated in the toner feed device 4, the transport member 42 does not effectively work, and defective feed of the toner occurs, is avoided.

The transport member 42 includes a transport portion 42A that contributes to the transport of the toner, and a non-transport portion 42B that does not contribute to the transport of the toner and handles the movement of the shutter member 43 to the open position. In this exemplary embodiment, the non-transport portion 42B is provided upstream of the transport portion 42A in the transport direction of the toner (in the direction indicated by arrow H in FIG. 2). The shutter member 43 receives the effect of the non-transport portion 42B of the transport member 42 and moves to the open position.

If a portion of the transport member 42 that transports the toner handles the movement of the shutter member 43, the portion that transports the toner has to have a structure that retains the shutter member 43 after the shutter member 43 moves to the open position. The structure may disturb the flow of the toner. In this exemplary embodiment, the non-transport portion 42B that handles the movement of the shutter member 43 is provided in addition to the transport portion 42A used for the transport of the toner. Thus, a phenomenon, in which the structure that causes the shutter member 43 to move and retains the shutter member 43 at the open position disturbs the flow of the transport of the toner, is prevented.

Figure 5:
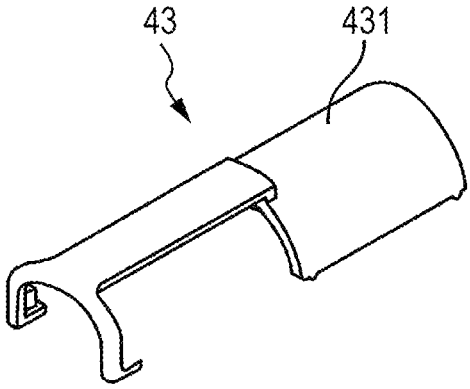
FIG. 5 is a perspective view of a shutter member.
Figure 6:
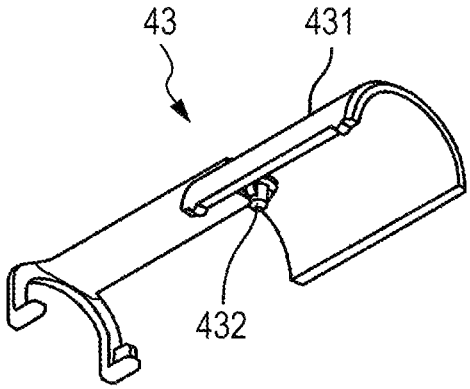
FIG. 6 is a perspective view showing an inner peripheral surface side of the shutter member.

FIG. 5 is a perspective view of the shutter member 43. Also, FIG. 6 is a perspective view showing an inner peripheral surface side of the shutter member 43 in FIG. 5.

The shutter member 43 has an arc-shaped shutter surface 431. The shutter surface 431 closes the opening 41*a* before the initial rotation of the transport member 42.

Also, the shutter member 43 has a protrusion 432 at an inner surface of the shutter member 43. The protrusion 432 protrudes to the transport member 42.

Figure 7:
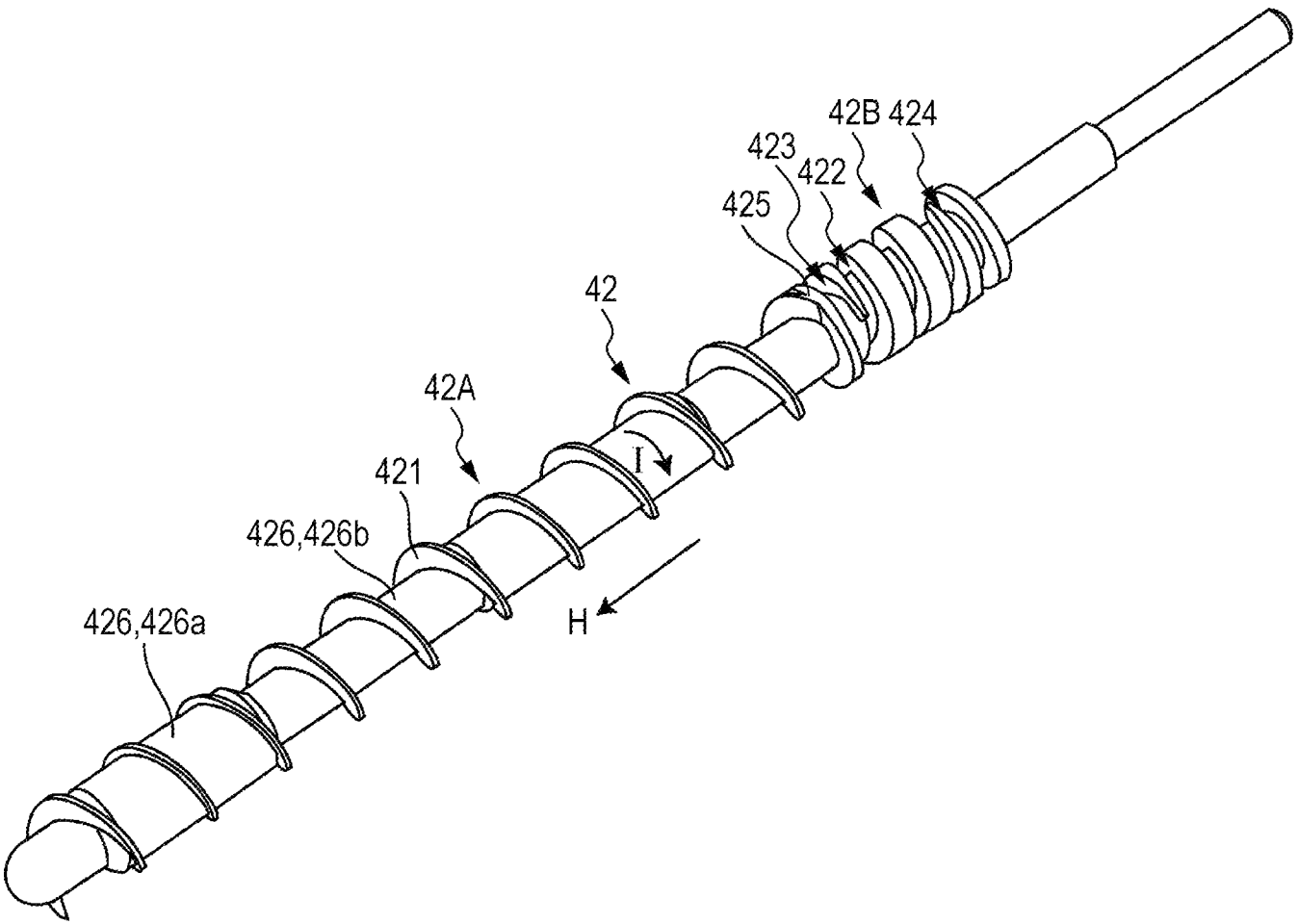
FIG. 7 is a perspective view of a transport member.

FIG. 7 is a perspective view of the transport member 42.

The entire transport member 42 extends in a rod shape, receives the drive force from the motor 111 (see FIG. 1), and is rotated in a direction indicated by arrow I. As described above, the transport member 42 includes the transport portion 42A and the non-transport portion 42B.

The transport portion 42A has a blade 421 having a spiral form around a rotation center line of the transport member 42. When the transport member 42 is rotated in the direction indicated by arrow I, the blade 421 transports the toner around the transport portion 42A in the direction indicated by arrow H. Also, a shaft 426 that is a portion of the transport portion 42A excluding the blade 421 has a large-diameter part 426*a* and a small-diameter part 426*b*. This is a countermeasure for increasing transportability of the toner by pressing the toner to the inner wall of the casing 41 and loosening the pressure.

The non-transport portion 42B is a portion that does not contribute to the transport of the toner and contributes to the transport of the shutter to the open position as described above. The non-transport portion 42B has a spiral groove 422 having a spiral or substantially spiral shape around the rotation center line of the transport member 42. The spiral groove 422 is rotated in a direction reverse to the direction of the blade 421 provided at the transport portion 42A. The protrusion 432 of the shutter member 43 (see FIG. 6) enters the spiral groove 422. When the transport member 42 is rotated, the spiral groove 422 guides the protrusion 432, and the shutter member 43 moves to the upstream side in the transport direction of the toner (in the direction indicated by arrow H). Hence, the shutter member 43 moved to the open position does not interrupt the transport of the toner by the transport portion 42A, or does not disturb the flow of the transport of the toner.

As shown in FIG. 2, the casing 41 and the transport member 42 of the toner feed device 4 according to this exemplary embodiment are arranged at a posture directed obliquely downward to the developing unit 21. Hence, the non-transport portion 42B of the transport member 42 causes the shutter member 43 to move in a direction opposite to the obliquely downward direction, i.e., to move obliquely upward.

As described above, since the transport member 42 is arranged at the obliquely downward posture to the developing unit 21, the transport portion 42A further smoothly transports the toner, and the toner in the transport portion 42A is prevented from entering the non-transport portion 42B.

The spiral groove 422 extends in a spiral or substantially spiral shape from a start position to an end position, which are described later. The start position is a position at which the protrusion 432 of the shutter member 43 enters the spiral groove 422 when the shutter member 43 is located at the closed position at which the opening 41*a* (see FIGS. 2 and 4) is closed. A start-side circumferential groove 423 is formed at the start position. The start-side circumferential groove 423 is connected with the spiral groove 422 and extends in a circumferential direction by one turn. The end position is a position at which the protrusion 432 of the shutter member 43 enters the spiral groove 422 when the shutter member 43 is at the open position at which the opening 41*a* is open. An end-side circumferential groove 424 is formed at the end position. The end-side circumferential groove 424 is connected with the spiral groove 422 and extends in the circumferential direction by one turn.

When the shutter member 43 moves to the open position, the protrusion 432 of the shutter member 43 enters the end-side circumferential groove 424, the transport member 42 is freely rotated with respect to the protrusion 432, and the shutter member 43 remains at the open position without moving from the open position.

The start-side circumferential groove 423 has a step 423*a* (see FIG. 4) provided in a depth direction. The step 423*a* has a step that causes the protrusion 432 of the shutter member 43 to fall into the spiral groove 422 from a position with a smaller depth than a depth of the spiral groove 422 when the transport member 42 is reversely rotated. During assembly of the process cartridge 2 as shown in FIG. 3, the transport member 42 may be unintentionally rotated. Then, the shutter member 43 may slightly move from the closed position toward the open position. The opening 41*a* may be slightly opened. In this exemplary embodiment, if such a phenomenon occurs, the transport member 42 is manually reversely rotated. Then, the spiral groove 422 guides the protrusion 432 of the shutter member 43, the shutter member 43 moves to the closed position, and the protrusion 432 enters the start-side circumferential groove 423. If the start-side circumferential groove 423 is not formed, the protrusion 432 comes into contact with the transport member 42 when the protrusion 432 moves to the start position of the spiral groove 422. The transport member 42 is not able to be rotated anymore. In this case, if the transport member 42 is forcedly rotated, a trouble, such as breakdown of the protrusion 432, may occur. Owing to this, the start-side circumferential groove 423 is formed, so that the transport member 42 is freely rotated without the protrusion 432 coming into contact with the transport member 42. Also, since the step 423*a* is formed at the start-side circumferential groove 423, if the transport member 42 is rotated in a normal direction (in the direction indicated by arrow I in FIG. 7), the protrusion 432 present in the start-side circumferential groove 423 comes into contact with the step 423*a*, is guided by the step 423*a*, enters the spiral groove 422, and is guided by the spiral groove 422 to the end position.

Also, the transport member 42 has a flange 425 at a boundary portion between the transport portion 42A and the non-transport portion 42B. The flange 425 extends along the circumferential direction by one turn, and has a large diameter to be close to an inner wall of the casing 41. The flange 425 blocks entry of the toner from the transport portion 42A to the non-transport portion 42B, and prevents the toner from entering the non-transport portion 42B.

Figure 8:
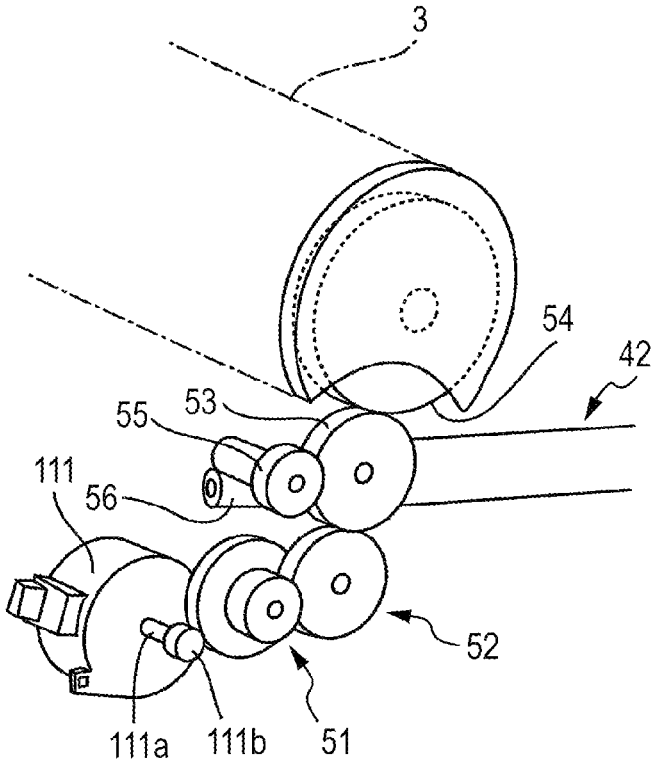
FIG. 8 is a perspective view showing a drive-force transmitting mechanism from a motor to the toner feed device.
Figure 9:
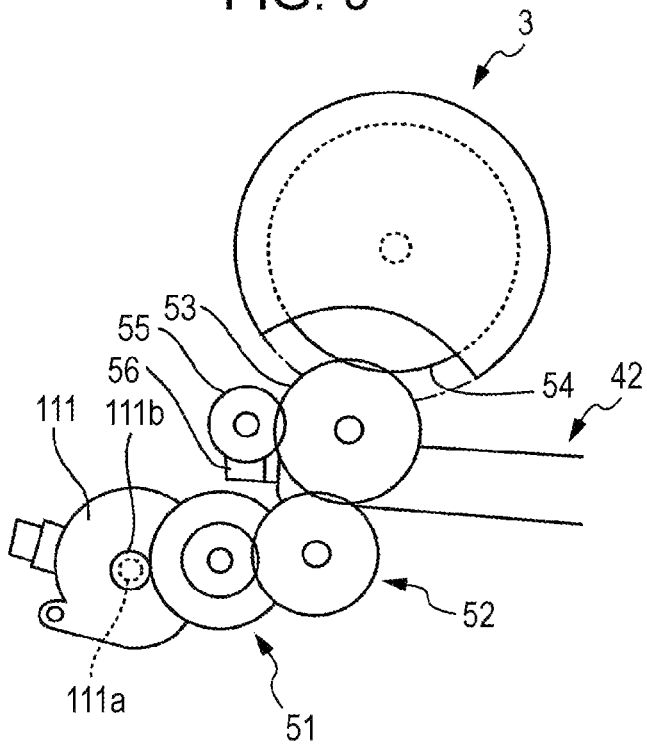
FIG. 9 is a front view showing the drive-force transmitting mechanism from the motor to the toner feed device.

FIG. 8 is a perspective view showing the drive-force transmitting mechanism from the motor 111 to the toner feed device 4. Also, FIG. 9 is a front view showing the drive-force transmitting mechanism.

The motor 111 (also refer to FIG. 1) has a shaft 111*a* and a gear 111*b* provided at the shaft 111*a*. A rotational drive force of the shaft 111*a* is transmitted to a gear 53 of the process cartridge 2 through idle gears 51 and 52 of the printer body 11, is transmitted to a gear 54 of the toner cartridge 3, and rotates the stirring member 31 (see FIG. 1) that stirs the toner in the toner cartridge 3.

The rotational drive force transmitted to the gear 53 is also transmitted to a gear 55 shown in FIGS. 2 and 4, is further transmitted to a gear 56, and rotates the transport member 42 of the toner feed device 4.

The process cartridge 2 is removably mounted on the printer body 11. When the process cartridge 2 is not mounted on the printer body 11, the gear 53 does not mesh with the gear 52 of the printer body 11. Also, the toner cartridge 3 may be removed from the process cartridge 2. When the toner cartridge 3 is not present, the gear 53 does not mesh with the gear 54, and the gear 53 may be manually rotated.

When the shutter member 43 unintentionally moves from the closed position to the open position, the gear 53 is manually reversely rotated. Then, a drive force of reverse rotation is transmitted to the gears 55 and 56, the transport member 42 is reversely rotated, and the shutter member 43 moves to the closed position.

In the above-described exemplary embodiment, the toner feed device 4 is applied to the printer 1 that performs printing with a single color. However, the toner feed device 4 may be applied to, for example, a tandem printer that forms a color image.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder feed device, comprising:

a casing having an opening, a powder sent from a powder housing portion being received through the opening, the powder housing portion housing the powder, the casing extending to a fed body, the fed body being fed with the powder, at least an inner side of the casing having a substantially cylindrical shape;

a transport member that rotates and transports the powder received in the casing through the opening to the fed body, the transport member being arranged in the casing and extending in a transport direction, the powder being transported in the transport direction; and a shutter member that is arranged at a closed position at which the opening is closed, receives a force from the transport member by the rotation of the transport member, and moves to an open position at which the opening is open, wherein the transport member includes a transport portion that contributes to the transport of the powder, and a non-transport portion that does not contribute to the transport, and handles the movement of the shutter member to the open position, and wherein the shutter member moves to the open position when the shutter member receives an effect of the non-transport portion.

2. The powder feed device according to claim 1, wherein the transport member includes the non-transport portion at an upstream side of the transport portion in the transport direction of the powder by the transport member, and wherein the non-transport portion causes the shutter member to move to the upstream side in the transport direction to the open position.

3. The powder feed device according to claim 2, wherein the casing and the transport member are arranged at a posture directed obliquely downward to the fed body, and wherein the non-transport portion causes the shutter member to move obliquely upward.

4. The powder feed device according to claim 1, wherein the shutter member has a protrusion that protrudes to the transport member, and wherein the non-transport portion has a spiral groove that guides the protrusion when the protrusion enters the spiral groove, the spiral groove being formed in a substantially spiral shape around a rotation center line of the transport member, from a start position, at which the protrusion enters the spiral groove when the shutter member is at the closed position, to an end position, at which the protrusion enters the spiral groove when the shutter member is at the open position, an end-side circumferential groove that retains the shutter member at the open position, the end-side circumferential groove being connected with the spiral groove at the end position and extending in a circumferential direction by one turn, and a start-side circumferential groove being connected with the spiral groove at the start position and extending in the circumferential direction by one turn, the start-side circumferential groove having a step provided in a depth direction, the protrusion falling into the spiral groove from a position with a smaller depth than a depth of the spiral groove when the transport member is reversely rotated.

5. The powder feed device according to claim 1, wherein the transport member has a flange that prevents the powder from entering from the transport portion to the non-transport portion, the flange being formed at a boundary portion between the transport portion and the non-transport portion, extending in the circumferential direction by one turn, and having a large diameter to be close to an inner wall of the casing.

6. An image forming apparatus, comprising:

an image holding body that holds a latent image, and after the latent image is developed with a powder, holds a powder image;

a developing unit that develops the latent image on the image holding body with the powder and forms the powder image on the image holding body;

a transfer unit that transfers the powder image on the image holding body, on a transferred body;

a fixing unit that fixes the powder image transferred on the transferred body, to the transferred body;

a powder housing portion that houses the powder and sends the housed powder; and a powder feed unit that receives the powder from the powder housing portion, transports the powder to the developing unit, and feeds the powder to the developing unit, wherein the powder feed unit includes a casing having an opening, the powder sent from the powder housing portion being received through the opening, the casing extending to the developing unit, at least an inner side of the casing having a substantially cylindrical shape, a transport member that rotates and transports the powder received in the casing through the opening to the developing unit, the transport member being arranged in the casing and extending in a transport direction, the powder being transported in the transport direction, and a shutter member that is arranged at a closed position at which the opening is closed, receives a force from the transport member by the rotation of the transport member, and moves to an open position at which the opening is open, wherein the transport member includes a transport portion that contributes to the transport of the powder, and a non-transport portion that does not contribute to the transport, and handles the movement of the shutter member to the open position, and wherein the shutter member moves to the open position when the shutter member receives an effect of the non-transport portion.

* * * * *